United States Patent [19]

Skinner

[11] Patent Number: 4,653,586

[45] Date of Patent: Mar. 31, 1987

[54] METHOD AND APPARATUS FOR CONTROLLING SAND ACCUMULATION IN A PRODUCING WELLBORE

[75] Inventor: James L. Skinner, Plano, Tex.

[73] Assignee: Atlantic Richfield Company, Los Angeles, Calif.

[21] Appl. No.: 811,929

[22] Filed: Dec. 20, 1985

[51] Int. Cl.[4] ..... E21B 43/08

[52] U.S. Cl. ..... 166/278; 166/228

[58] Field of Search ..... 166/278, 276, 280, 51, 166/228, 233, 227, 370, 265, 105.5, 105.6

[56] References Cited

U.S. PATENT DOCUMENTS

| | | | |
|---|---|---|---|
| 1,175,599 | 3/1916 | Butler | 166/105.6 |
| 1,289,320 | 12/1918 | Halstead | 166/228 X |
| 1,572,330 | 2/1926 | Taylor | 166/105.6 |
| 3,556,219 | 1/1971 | Meldau | 166/228 X |
| 3,999,608 | 12/1976 | Smith | 166/51 X |
| 4,018,282 | 4/1977 | Graham et al. | 166/227 X |

*Primary Examiner*—Stephen J. Novosad
*Assistant Examiner*—David J. Bagwell
*Attorney, Agent, or Firm*—Michael E. Martin

[57] ABSTRACT

A gravel pack well completion includes an elongated gravel pack screen connected at its upper end to a production tube which in turn is connected to a production fluid pump. The gravel pack screen includes an elongated tube interposed therein and having a primary inlet located generally in the vicinity of the lower end of the screen for maintaining sufficient liquid flow velocity within the screen to prevent settling and accumulation in the wellbore of entrained fine solids entering said screen with production liquids. A gas port is provided in the upper end of the draft tube to conduct gas into said production tube and to prevent significant accumulation of gas in the wellbore at the gravel pack.

2 Claims, 2 Drawing Figures

METHOD AND APPARATUS FOR CONTROLLING SAND ACCUMULATION IN A PRODUCING WELLBORE

BACKGROUND OF THE INVENTION

Field of the Invention

The present invention pertains to a downhole pumping system for fluid producing wells wherein an elongated production fluid draft tube is arranged in relation to a gravel pack to minimize sand accumulation in the gravel pack and in the wellbore at or directly below the production zone.

BACKGROUND

In many well completions for producing liquid hydrocarbons, the produced fluid may contain significant amounts of relatively fine solids such as clay, fine sand, and other silt-like matter. The influx of these materials into the wellbore is typically minimized in the production zone or interval by the presence of a section of production tubing which forms a durable perforated metal screen or a slotted liner which is surrounded with packed gravel to serve as a filtering material. This arrangement of a well completion is typically characterized as a "gravel pack" wherein the gravel serves as a screening or filtration medium and the slotted liner or screen prevents the gravel itself from passing into the fluid production tubing in the well.

In conventional gravel pack well completions the gravel pack screen comprises an elongated tubular structure which may be on the order of up to 400–500 feet in length and is disposed in the production tubing string below a pumping apparatus. Accordingly, a section of tubing between the gravel pack screen or slotted liner serves as an intake conduit for the production fluid pump and during pump operation fluid flowing into the section of tubing directly above the gravel pack screen is subjected to a somewhat lower pressure than the pressure gradient across the length of the gravel pack screen. This lower pressure at the top of the gravel pack screen tends to induce more flow through the gravel pack in that vicinity and fluid velocities through a major portion of the gravel pack and the fluid passage formed inside the gravel pack screen are typically much lower because of the much larger cross sectional area available for fluid flow. Accordingly, in reservoirs being produced wherein the produced fluid contains a significant amount of fine solids which pass through the gravel pack the lower fluid velocities in the lower regions of the gravel pack screen will tend to cause sedimentation inside the screen or liner structure. Once the solids start to accumulate in the lower region of the gravel pack screen, they will eventually fill up the inside of the screen and effectively stop flow fluids from the adjacent areas of the production zone or interval.

Accordingly, over a period of time the gravel pack screen or liner will "sand up" and the apparent bottom of the wellbore will move vertically upward. Eventually this action can significantly reduce well productivity to the point where the pumping effort is uneconomical and the well must be cleaned out using a workover system, a coiled tube injection process, or other suitable means. Clearly, the reduction in well productivity, the interruption of production to provide for clean-out operations and the cost of the clean-out operation itself can significantly impact the economics of producing hydrocarbons from formations requiring gravel pack well completions. It is an object of the present invention to overcome the deficiencies of prior art gravel pack well completions by providing a method and apparatus which minimizes the accumulation of silt in the wellbore in the production interval and maintain sufficient produced fluid velocities through the gravel pack and the gravel pack screen or liner.

SUMMARY OF THE INVENTION

The present invention provides an improved well completion of the general type utilizing a gravel pack filter for preventing the excessive accumulation and entrainment of solids produced with production fluids in a subterranean wellbore. In accordance with one aspect of the present invention there is provided an arrangement of a gravel packed production zone wherein an elongated gravel pack screen or foraminous production liner is interposed in the production tubing and forms a barrier between a gravel pack zone in the wellbore and a flow passage for producing wellbore fluids to flow upward into the production tubing or conduit and wherein there is provided an elongated production fluid pump inlet or draft tube within the flow passage formed by the liner or screen in such a way as to minimize the accumulation of relatively fine silt or sand inside the screen or liner.

In accordance with another aspect of the present invention there is provided an improved well completion arrangement wherein an elongated gravel pack screen is provided in the production interval or zone and includes an elongated tube extending substantially from the upper end of the screen or liner to a point adjacent to the lower end of the screen and forming an inlet for produced fluids to flow upward into the production tubing and to the inlet of a jet pump or other pumping apparatus disposed in the wellbore. The arrangement of the draft or pump inlet tube within the gravel pack screen is such as to form a fluid inlet to the tube at a point which will minimize the accumulation of sediment in the gravel pack screen and will maintain higher fluid velocities through the gravel pack and within the interior of the gravel pack screen as well as more uniform flow through the gravel pack.

In accordance with another aspect of the present invention, the improved gravel pack screen, production tube and pumping arrangement includes one or more gas flow ports formed in the draft tube at a point which minimizes the accumulation of gas in the wellbore in the vicinity of the production fluid pump inlet and prevents gas accumulations which would reduce the flow of liquid into the wellbore to a level below the desired production level.

In accordance with yet a further aspect of the present invention, there is provided an improved method for producing fluids from a subterranean production zone or interval which minimizes the chance of sanding up or plugging the wellbore and thereby requiring the performance of cleanout operations or abandonment of the production interval. The method contemplates the provision of means for transferring the point of lowest fluid pressure inside a flow passage defined by a gravel pack screen or liner from a point in the vicinity of the top of the screen or liner to a point in the vicinity of the bottom end thereof. The improved method contemplates the modification of conventional well completion apparatus by the provision of an elongated pump inlet or draft tube interposed in a gravel pack screen or liner for moving the zone of highest fluid flow rate inside the screen or liner from the upper region thereof to the lower region thereof in an otherwise substantially conventional gravel pack well completion. Those skilled in the art will recognize the abovementioned features and advantages of the present invention together with additional superior aspects thereof upon reading the detailed description which follows in conjunction with the drawing.

DESCRIPTION OF THE PREFERRED EMBODIMENTS

Figure 1:
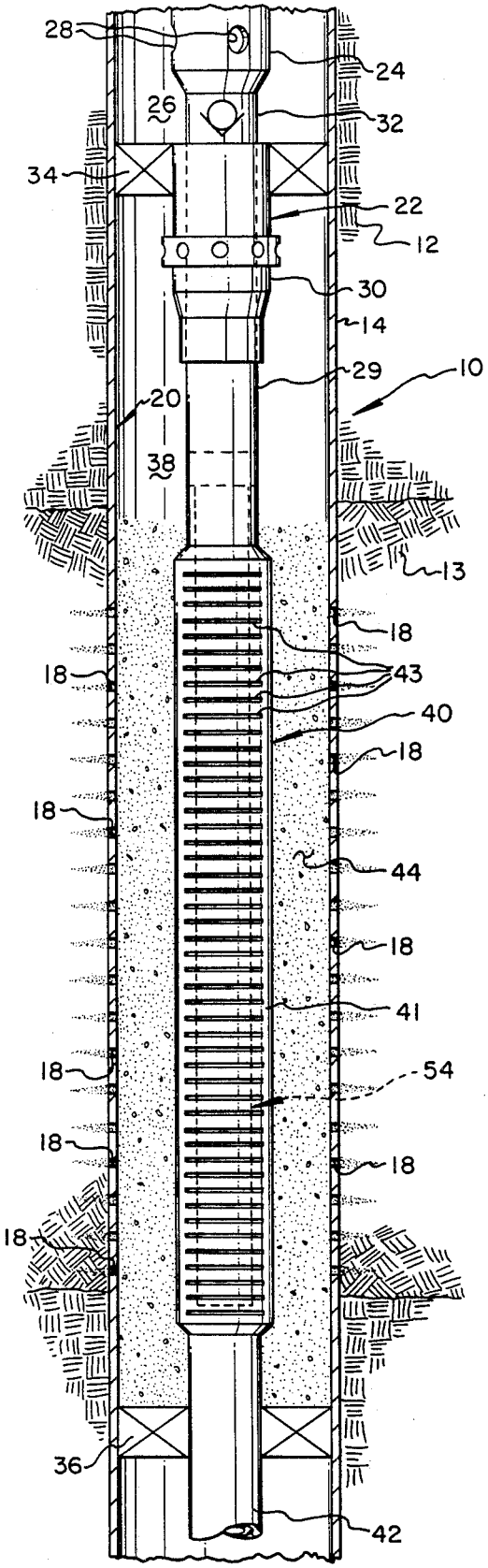
FIG. 1 is a vertical section view in somewhat schematic form of a well completion embodying the method and apparatus of the present invention.

In the description which follows, like parts are marked throughout the specification and drawing with the same reference numerals, respectively. The drawing figures are in somewhat schematic form in the interest of clarity and conciseness and conventional elements known to those of ordinary skill in the art are illustrated in schematic form only.

Referring to FIG. 1 there is illustrated a portion of a subterranean well 10 which has been drilled into a fluid producing earth formation 12 and has been completed to provide for control of the accumulation and settling of sand and other silt-like materials which may be carried with the fluids being produced from the formation 12 into and through the fluid flow path up and out of the well 10. The well 10 includes a section of conventional production casing 14 extending into and through an interval 13 of the formation 12 from which fluids are to be produced. Illustrations of conventional surface equipment and sections of the well 10 above and below the area of interest have been eliminated in the interest of clarity and conciseness. Suffice it to say that those of ordinary skill in the art of drilling and completing wells for the production of hydrocarbon fluids will be enabled to practice the present invention upon reading the further detailed description which follows herein.

As illustrated in FIG. 1 the casing 12 has been perforated by a plurality of openings or perforations 18 at the formation production interval 13 to permit the flow of liquid and gaseous hydrocarbons into the wellbore 20 defined by the casing 14. In the arrangement illustrated the production interval 13 is adapted to be produced by the insertion of a production tubing string generally designated by the numeral 22 and including a production fluid pump 24 of the so called power fluid or jet pump type. The pump 24 is preferably of a type known in the art which operates by the eductor or ejector effect through the pumping of power oil or other suitable power fluid down through an annular area 26 formed in the wellbore 20 and through a series of inlet ports 28 into an internal pump cavity, not shown, whereby fluid is lifted through a conduit section 29 which extends through a conventional gravel pack assembly 30 and is in communication with a conventional check valve or standing valve 32. The wellbore 20 is packed off between conventional casing packers 34 and 36 to provide a cavity 38 into which fluids may flow through the perforations 18. Those skilled in the art will recognize that the well 10 may be uncased in the area of the production interval 13 in certain completions.

An elongated gravel pack screen or slotted liner 40 extends below the tubing 29 and includes a tail pipe or tubing section 42 which is suitably connected to and is journalled by the packer 36. The liner 40 is characterized as an elongated foraminous tubular member 41 having a substantial number of elongated thin slots 43 formed therein. The production interval 13 is presumed to be of a type whereby relatively significant amounts of fine silt-like matter such as sand, and other earthy solid particles are entrained with the fluids as they enter the cavity 38. In order to minimize the accumulation of these materials in a manner which would eventually plug the wellbore 20, the cavity 38 is packed with a quantity of gravel 44 substantially over the entire length of the screen or liner 40. The screen or liner 40 thus forms a barrier to entrainment of the gravel with production fluid flow and a relatively large unobstructed flow passage 46, FIG. 2, is formed within the interior of the screen or liner for flow of liquid up through the tubing section 29, the gravel pack assembly 30, the standing valve 32, and through the jet pump 24 to the surface, not shown whereby the produced fluids are handled in a conventional manner.

The packed gravel 44 may be provided of various mesh sizes of gravel material in accordance with the amounts and expected particle size of fine solids which are entrained with the fluids flowing into the wellbore cavity 38. There is, of course, a practical limit as to the size range of the gravel particles since it is the spaces formed between the gravel particles which permit the flow of fluids into the wellbore. If large amounts of relatively fine solids, say in the range of 150–200 mesh (Tyler or U.S. Standard Screen Size), are being produced with the well fluids, it may be impractical to provide gravel 44 having a screen size smaller than this since the flow resistance presented by such a fine gravel pack may not permit sufficient flow rates to make the well economically viable. Accordingly, the gravel pack material may require to be sized to permit the passage of relatively fine solids into the flow passage 46 by passing through the gravel pack and the screen or liner 40.

Figure 2:
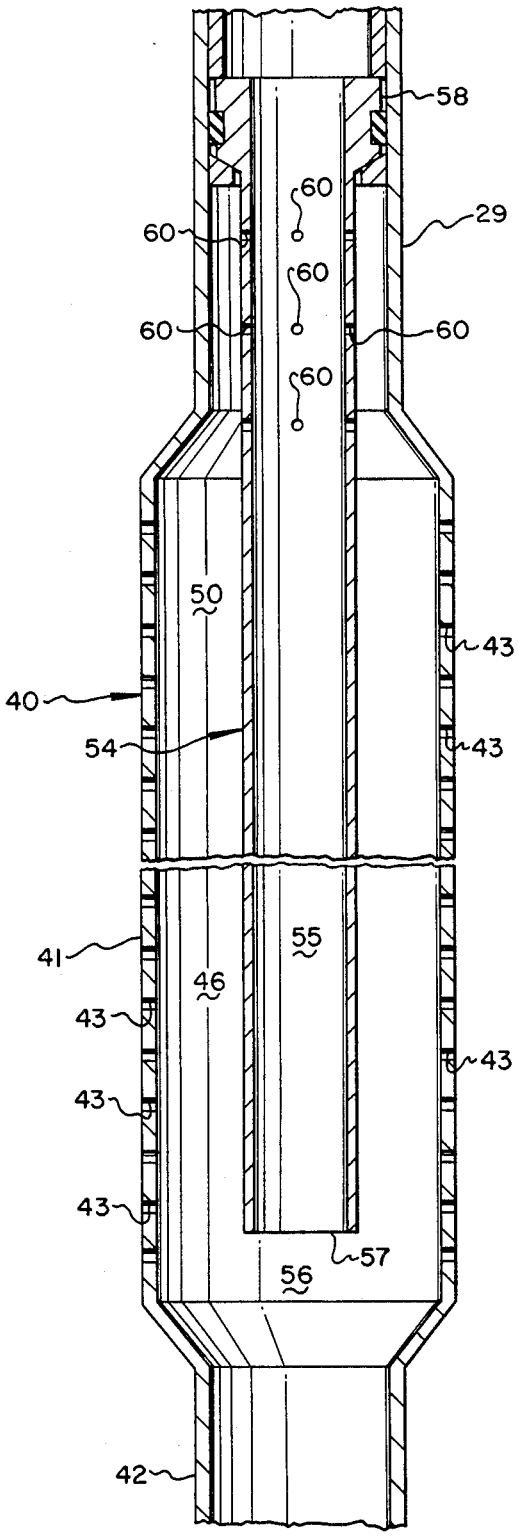
FIG. 2 is a section view of a portion of the well completion illustrated in FIG. 1 and showing the elongated pump inlet flow control or draft tube arrangement within the gravel pack screen.

In a conventional gravel pack screen arrangement the flow passage 46 is generally unobstructed between the tail pipe 42 and the tubing 29 and the suction pressure of the jet pump 24 is such that a relatively low pressure zone develops in the flow passage 46 generally in the vicinity of the juncture between the liner 40 and the tubing section 29 and which is designated by the numeral 50 in FIG. 2. This pressure gradient or unbalanced pressure condition results in relatively large fluid flow rates through the gravel pack and the liner 40 in the immediate vicinity of the zone 50 while flow rates of liquids entering the gravel pack and the flow passage 46, in particular, below this zone are progressively lower. Since the relatively high solid loadings of the liquids entering the flow passage 46 require relatively high flow velocity to prevent settling or sedimentation, conventional completions wherein the flow passage 46 is virtually unobstructed between the tail pipe 42 and the tubing section 29 are subject to relatively rapid build-up of settled solids which further aggravates the condition providing for reduced flow of fluids from the production interval 13 along the lower regions thereof into the wellbore cavity 38. Such a condition results in a rapid sanding up of the well and requires the shutdown of production so that well cleanout operations may be carried out.

FIGS. 1 and 2 illustrate a unique modification of a well completion arrangement wherein there is provided an elongated pump inlet or draft tube 54 extending within the flow passage 46 from a point preferably above the juncture of the tubing section 29 with the liner 40 to a point generally directly above the bottom of the gravel pack liner 40, which area is generally designated by the numeral 56. The draft tube 54 comprises an elongated cylindrical tube having an annular shoulder 58 formed at the upper end thereof and suitably secured within the tubing 29 at the point illustrated. A plurality of circumferentially and axially spaced ports 60 are formed in the side wall of the draft tube 54 generally in the region of the tubing 29 from the zone 50 upward. Alternatively, the upper end of the draft tube 54 may be located directly at the juncture between the gravel pack liner or screen 40 and the tubing 29 although an arrangment in accordance with the dimensions given for an example hereinbelow may be preferred.

The provision of the draft tube 54 reduces the tendency for the accumulation of solids in the passage 46 by maintaining increased flow of liquids into the interior flow passage 55 of the draft tube 54 at the inlet thereto, generally designated by the numeral 57. The location of the tube inlet 57 provides for increased flow of well liquids at a point in the passage 46 which minimizes the accumulation of solids in the lower portions of the passage 46. In effect, the provision of the tube 54 transfers the zone of lowest flow rate from the zone 56 to the zone 50. However, fluids entering the passage 46 at progressively higher points through the openings 43 in the liner or screen 40, even if at lower flow velocities, will not result in increased sedimentation within the passage 46 since any settling of silt or solids entrained with the well liquids will be re-entrained with the liquids entering the inlet 57 due to the relatively high flow velocities in the zone 56. These solids will thus be carried out of the well with the produced liquids. Thus the well 10 with the improved completion system is substantially self-cleaning, in that the produced liquids are used to sweep out the zone or area 56 within the passage 46 and there will be no tendency for solids to accumulate within the liner screen 40. This improved arrangement will also substantially preclude the accumulation of solids in the tail pipe 42 or in any rat-hole portion of the wellbore below the zone being produced.

The provision of the ports 60 also accommodates those wellbores wherein gas is being produced along with formation liquids while precluding the substantial accumulation of such gas in the cavity 38. In normal operation a differential pressure will exist between the fluid pressure in the passage 46 and the passage 55 due to friction losses in the fluid flowing up through the latter passage which will provide impetus for gas to flow into passage 55 through the ports 60 to prevent accumulation of gas in the top of the passage 46 and eventually possibly blocking the flow of liquids into the interior of the screen or liner 40. If no gas is being produced from the formation interval 13, there is some small flow of liquid through the ports 60 into the passage 55 which gives rise to selection of the flow area of the ports 60 to be such that substantially all of the expected gas flow is handled through the ports 60 without the provision of undue liquid leakage into the passage 55 during periods of production when the gas-to-oil ratio of the formation fluids produced is relatively low. The sizing of the gas ports 60 will, of course, depend on the expected gas flow and other parameters including the dimensions of the production tubing 29 and the draft tube 54.

For example, by way of illustration only, consider an oil well producing an estimated 600 barrels per day with a gas-to-oil ratio at the wellbore of 300 standard cubic feet of gas per barrel of oil produced. With a tubing 29 having an inside diameter of approximately 2.44 inches, a gravel pack screen or liner 40 with an inside diameter of approximately 2.98 inches, and a tube 54 formed of 1¼ inch standard schedule 40 pipe (ASA B 36.10) with a single gas port 60 at the top thereof of approximately 0.19 inches diameter, the expected pressure drop between the inlet 57 and the ports 60 may be calculated assuming further additional parameters. Namely, the length of the screen 40 and the tube 54 are assumed to be approximately 400 feet and the well 10 is producing oil having a viscosity of 60 centipoise and a gravity of 20° API and assuming a reservoir temperature of 75° F. Further, assuming that the fluid pressure at the inlet to the jet pump 24 is approximately 500 psig it may by calculation be determined that a 32 psi pressure drop will occur between the inlet 57 and the upper end of the draft tube 54. With this differential pressure, gas will flow through the gas port 60 into passage 55 approximately 87.4 percent of the time, and oil will be produced through the port 60 into the passage 55 approximately 12.6 percent of the time. When oil rather than gas is flowing through the port 60, thirty percent of the total oil to the jet pump 24 will enter through the gas port 60. Over a steady state period a total of 3.7 percent of the produced oil will enter the flow path provided by the draft tube passage 55 and the tube 29 through the port or ports 60 and, of course, 96.3 percent of the produced oil, or liquid with similar characteristics, will enter the tube 54 through the inlet 57. Accordingly, a substantial portion of the produced liquid will flow through the zone 56 at relatively high velocity to preclude the accumulation of sand and other solids in the passage 46 in a way which will require other clean-out operations.

Although preferred embodiments of the invention have been described in detail herein, those skilled in the art will recognize that various substitutions and modifications may be made to the embodiments described without departing from the scope and spirit of the invention as recited in the appended claims.

What I claim is:

1. In a well completion for producing a flow of liquids into a wellbore wherein said liquids contain relatively fine solids entrained in the flowing liquid, a wellbore including a production fluid tube disposed in said wellbore and operably connected to one end of an elongated gravel pack screen, a gravel pack in said wellbore at a production interval in a formation which yields said liquids into said wellbore and interposed between said screen and said formation for filtering relatively coarse solids entrained in said liquid and before said liquid flows into a flow passage defined by said screen, pump means operably connected to said production tube for drawing liquid from said passage in said screen through said production tube for delivery to the earth's surface, and an elongated draft tube operably connected to said production tube and extended substantially coaxially within said screen from one end of said screen to the other, said draft tube having an inlet opening positioned in a region generally at the end of said screen opposite said one end for withdrawing liquids from said passage and into said draft tube, said draft tube including port means disposed therein at a point in the vicinity of said one end of said screen and opening into the interior of said draft tube, said port means being sized to provide for the flow of gas produced in said wellbore into the interior of said draft tube during production of liquids from said wellbore only at such a rate as to prevent the accumulation of gas in said wellbore while forcing the major portion of liquids drawn into said production tube by said pump means to flow through said inlet opening at a relatively high velocity in said region to minimize the accumulation of solids in said wellbore.

2. A method for producing liquids having a relatively significant amount of entrained solids through a wellbore drilled into a fluid producing formation while minimizing the accumulation of solids in said wellbore comprising the steps of:

providing an elongated gravel pack screen disposed in said wellbore, said screen being operably connected at one end to a production tube, said production tube being operably connected to pump means for pumping liquids from said wellbore;

providing a gravel pack in said wellbore substantially surrounding said screen for filtering relatively coarse solids from said liquids flowing from said formation into an interior flow passage defined by said screen;

providing an elongated tube in fluid flow communication with said production tube and said pump means, said elongated tube having a primary inlet positioned in a region remote from said one end of said screen and defining a flow path for liquids from said inlet to said production tube, said elongated tube including a port in the vicinity of said one end of said screen for conducting gas in said flow passage into said production tube for evacuation from said wellbore, said port being sized such that a major portion of liquids entering said flow passage from said formation are forced to flow through said inlet of said elongated tube and through said flow path so as to maintain a sufficient liquid flow velocity to prevent substantial accumulation of solids in said flow passage; and withdrawing liquids from said flow passage and into said production tube from a point generally in a region of said screen remote from said one end at a velocity sufficient to preclude the substantial settling and accumulation of solids in said flow passage.

* * * * *